United States Patent [19]

Montgomery et al.

[11] Patent Number: 4,895,295

[45] Date of Patent: Jan. 23, 1990

[54] MULTIPLE PRODUCT WRAPAROUND CARRIER

[75] Inventors: H. Curtis Montgomery; David J. McKenna, both of Lacey, Wash.

[73] Assignee: Weyerhaeuser Company, Tacoma, Wash.

[21] Appl. No.: 257,131

[22] Filed: Oct. 11, 1988

Related U.S. Application Data

[63] Continuation of Ser. No. 34,462, Apr. 3, 1987, abandoned.

[51] Int. Cl.[4] ..... B65D 5/42; B65D 5/46

[52] U.S. Cl. ..... 229/9; 229/40; 229/117.15

[58] Field of Search ..... 229/9, 19, 40, 52 B, 229/23 R; 206/499

[56] References Cited

U.S. PATENT DOCUMENTS

| | | | |
|---|---|---|---|
| 2,038,454 | 4/1936 | Stevenson | 229/9 |
| 2,751,135 | 6/1956 | Kessler | 229/9 |
| 3,126,140 | 3/1964 | Cizan et al. | 229/52 B |
| 3,140,813 | 7/1964 | Hall et al. | 229/52 B |
| 3,346,167 | 10/1967 | Schmidt | 229/23 R |
| 3,416,719 | 12/1968 | Pilger | 229/17 R |
| 3,521,810 | 7/1970 | Boyer | 229/9 |
| 4,058,211 | 11/1977 | Barbieri et al. | 229/9 |
| 4,171,763 | 10/1979 | Card | 229/52 B |
| 4,392,605 | 7/1983 | Backman | 229/9 |

FOREIGN PATENT DOCUMENTS

| | | | |
|---|---|---|---|
| 1380921 | 1/1975 | United Kingdom | 229/9 |

*Primary Examiner*—Gary Elkins

[57] ABSTRACT

A single piece carrier of the wrap around style is comprised of a plurality of hinged walls that can be wrapped about a plurality of articles such as flats of eggs. The carrier is erected by encircling the articles and at the top of the carrier a hand hold is formed by inserting the hand hold portion through a slot in the top wall. A locking flap is located along one side of the overlying top wall which is then inserted into a corresponding slot in the other top wall portion and locked in place. A locking tab is then forced inwardly through an aperture within the locking flap and when the tab is in the interior it serves as a locking abutment member holding the articles securely in place. An additional locking means consisting of inwardly extending flaps serves to prevent product slideout.

2 Claims, 1 Drawing Sheet

MULTIPLE PRODUCT WRAPAROUND CARRIER

This application is a continuation of application Ser. No. 034,462, filed Apr. 3, 1987, now abandoned.

BACKGROUND OF THE INVENTION

This invention relates generally to a paperboard container that serves as a carrier for a plurality of packaged goods. More particularly it relates to a paperboard carrier suitable for containing a multiplicity of egg flats and which can be easily loaded at an egg ranch or a retail outlet.

Of course, when packaging eggs the container or carrier must be capable of supporting the eggs in a relatively stationary manner so none break either from being too loosely packed and sliding out or from too tightly packed and the resultant effects of compression. In present day food buying many consumers are electing to purchase in volume in order to effect price savings and consequently, appropriate packaging is needed to contain and hold a plurality of individual boxes holding the particular food items. Packaged eggs represent a particularly difficult containment and carrier problem due to their fragility. When consumers pick up eggs, the package containing them must be capable of supporting the eggs and providing resistance to breakage. The present invention was developed to provide a convenient carrier to hold a plurality of egg flats or boxes so that when the consumers elect to purchase in volume, he or she could simply pick up the carrier and after payment carry it away for ultimate consumption.

Thus, what had became needed was a relatively low cost, easy to assemble paperboard carrier that was functional for holding eggs and other similar items.

One common way of supporting and displaying eggs at the point of purchase is by nesting each individual egg within a molded pulp support tray. These can in effect become the individual packages supporting a plurality of eggs. These individual supporting trays can then be placed within a carrier for convenient carryout. Once the trays of eggs are in the carrier, they should be relatively locked in place and the carrier should have a convenient carryout handle. In addition, the carrier must be easy and quick to load with the packaged goods and attractive at the point of purchase.

The present carrier design provides all of the necessary design features and functionality and has proved to be a very popular carrier design. Yet another advantage of the design is that it can be shipped in a flat condition and then at an egg ranch or the retail outlet workers who are stacking product can easily package a multiplicity of separate product. These and other objects of the present invention will be better understood upon reading the specification to follow in conjunction with the attached drawings.

BRIEF SUMMARY OF THE INVENTION

Briefly stated, the present invention is practiced in one form by a flexible carrier of the wrap-around style which has a first bottom wall, a first and second upstanding side wall and first and second top wall forming portions. The first top wall portion traverses the entire width of the carrier and one portion of it overlies the second wall portion. Within the first top wall portion is a longitudinal slot through which fits the upstanding hand hold which is hinged to the elongated edge of the second top wall portion. Along the elongated edge of the first top wall portion is an elongated locking tab that fits within a corresponding slot cut within the second top wall portion adjacent its hinge line. A small locking tab is cut in part from the second top forming portion and in part from the second side wall and after the carrier is packed with product, it is pushed inwardly and through a corresponding aperture in the locking tab on the first top wall portion to a position where it acts to in effect lock the contained product within the carrier. An additional product locking means is at the bottom of the carrier and is a cut and scored portion of the bottom wall and adjacent upstanding side wall which is pushed inwardly after the product is inserted and thereafter holds or locks the product in place.

DETAILED DESCRIPTION OF THE PREFERRED EMBODIMENT

Figure 1:
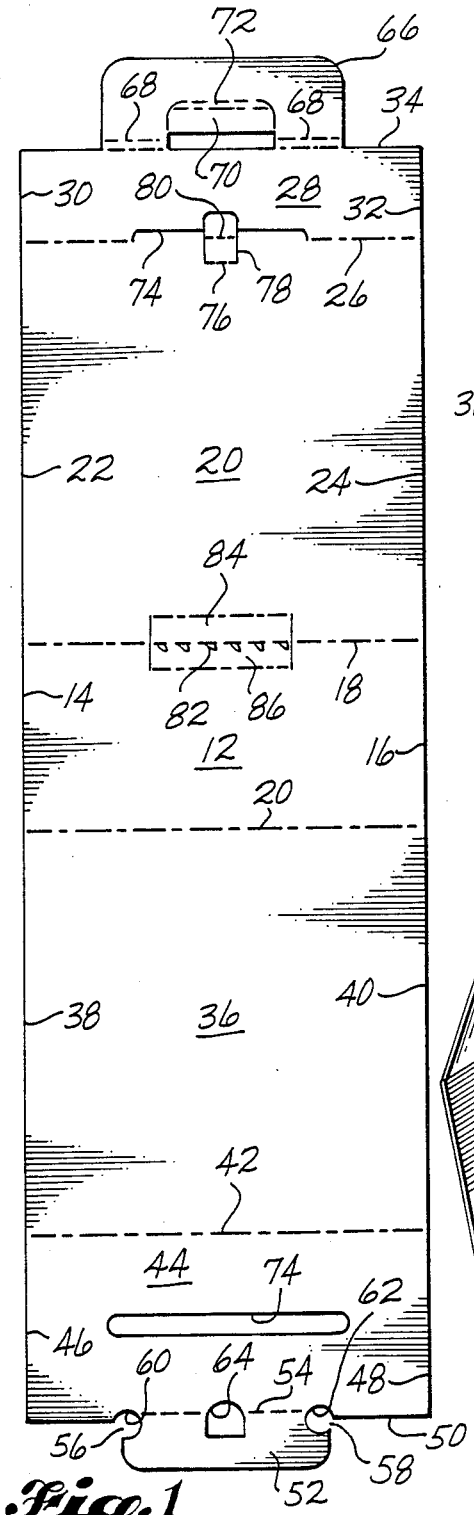
FIG. 1 is a top plan view looking down at the carrier blank as it is cut from a sheet of corrugated paperboard.
Figure 3:
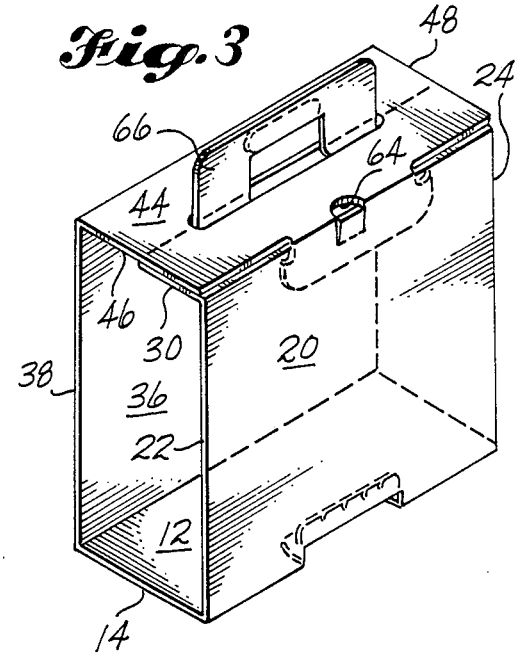
FIG. 3 is a view similar to FIG. 2 showing the carrier in its completely erected form just prior to having product loaded and the product locking means pushed inwardly.
Figure 2:
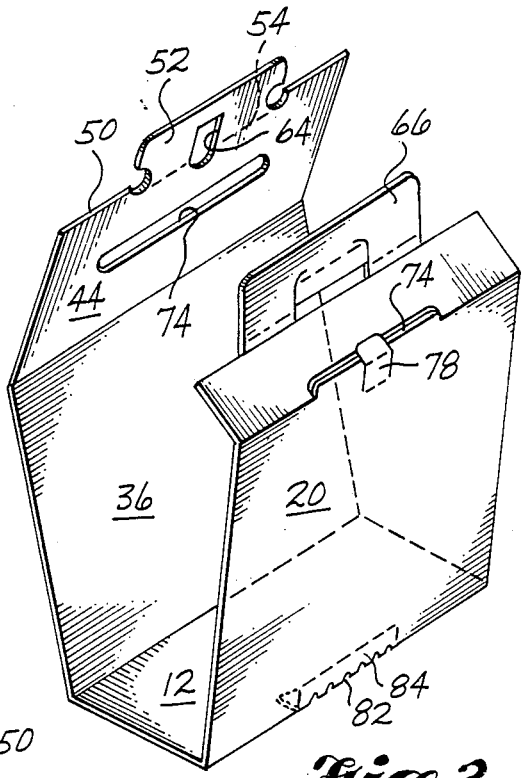
FIG. 2 is an isometric view showing the carrier in its partially erected form.

Referring first to FIG. 1, the carrier blank from which the erected carrier will be formed is generally indicated at 10. Blank 10 will ideally, although it is not absolutely essential, be cut from typical corrugated paperboard. Corrugated paperboard is material having corrugated medium in the center and two liners bonded to the tips of the corrugations. In order to provide vertical wall strength as will be better understood later, the corrugations in the corrugated board will extend in the vertical direction with reference to the blank of FIG. 1.

Blank 10 is substantially an elongated rectangle of flat corrugated material. Formed within blank 10 by common commercially available folding, scoring, perforating and die cutting equipment will be a first bottom portion 12, which is defined by two side edges 14, 16 and two hinged score lines 18, 20. Adjacent score line 18 and extending upwardly therefrom is the first side wall 20 having side edges 22, 24 and further defined by score lines 18 and upper score line 26. Extending upwardly from score line 26 is the second top forming portion 28 which is defined by side edges 30, 32 and score line 26 and upper free edge 34. Extending outwardly from score line 20 is the second side wall 36 defined by side edges 38, 40 and score line 20 and upper score line 42. As will be noted from referring to FIG. 1, the planar areas of the first and second side walls 20 and 36 are substantially equal.

Extending outwardly from score line 42 is the first top wall forming portion 44 which is defined by side edges 46, 48 and score line 42 and upper free edge 50.

Extending outwardly from free edge 50 is an elongated locking flap 52. Flap 52 is hinged to the free edge 50 along score line 54. Spaced cutouts 56, 58 are provided and create side locking edges 60, 62. Cut from locking flap 52 is locking aperture 64 in which will be positioned a locking tab to be described later.

Extending outwardly from the opposite free edge 34 is the hand hold member generally indicated at 66. Hand hold 66 is a common one substantially U-shaped in mature and hinged by way of a double score line 68 to the upper edge 34. The loose flap 70 will be folded upwardly to lay against the upper portion of hand hold 66 through double score line 72 when the carrier is finally erected. Located so as to interrupt score line 26 is an elongated slot 74. Slot 74 is dimensional substantially the same as locking flap 52 since flap 52 will be inserted into slot 74 as the carrier is erected. Cut from the upper edge portion of first side wall 20 and hinged thereto along score line 76 is locking tab 78. Locking tab 78 extends upwardly above the elongated slot 74. The dimension of locking tab 78 is substantially similar to that of locking aperture 64 since tab 78 will be pushed into aperture 64 and bent downwardly after the packing of the carrier. The bending of tab 78 is made easier by an additional score line 80 located in the tab approximately at its midpoint.

Located along score line 18 is a perforated section 82 from which extend on either side thereof a pair of joined together hinged small upper and lower flaps 84, 86. These flaps are pushed inwardly into the carrier once the carrier is erected and the contents inserted therein in order to provide a locking means to prevent the product from sliding out.

The carrier blanks can be preassembled and packed at an ranch or delivered to the retail outlet in a flat stacked form. When the carriers are ready for packing, the worker will take an individual carrier blank and lay it flat. A stack of product such as three egg flats containing spaced eggs will be preferably laid atop the second side wall 36 and the rest of the carrier blank wrapped around the articles. Any printing on the outside of the carrier blank will, of course, be facing outwardly. The rest of the walls are folded and wrapped about the products to be contained and the hand hold 66 is first inserted through slot 74 and pulled therethrough causing it to be folded about double score line 68. The first top wall forming portion 44 is then folded downwardly to lay atop the second top wall portion 28. The locking flap 52 is then inserted into elongated slot 74 and effectively locked in place. To provide the locking feature for securely holding the articles in place, the locking tab 78 is then pushed inwardly through aperture 64 so that it engages at least part of the packaged product and serves to provide a locking abutment within the carrier. The joined flaps 84, 86 are then also pushed inwardly to securely lock the product in place. These carriers with their product can then be placed for display and sale. Once a consumer has selected the article, they grasp the hand hold 66 causing the flap 70 to fold upwardly thereby forming the convenient handle.

Thus, it will be appreciated that a low cost, quickly erected, convenient carrier has been disclosed together with a locking feature for securely holding the contained articles. While a detailed description has been provided, changes and modifications will occur to those skilled in the art. All such changes and modifications are intended to be included within the scope of the appended claims.

We claim:

1. A flexible multiple egg flat carrier of the open ended wrap-around style, comprising:

a bottom wall, first and second upstanding side walls, first and second top wall forming portions, a slot in the first top wall portion through which extends an upstanding hand hold hinged to the second top wall portion, and a pair of joined flaps along a bottom edge formed from a portion of the bottom wall and an adjacent upstanding side wall adapted to be pushed inwardly after egg flats are inserted in the erected carrier to engage and hold the egg flats removably in place.

2. A multiple egg flat as in claim 1 further including a locking tab on an edge of the first top wall portion fittable within a slot in the second top wall portion.

* * * * *